US006800850B2

(12) United States Patent
Hirano et al.

(10) Patent No.: US 6,800,850 B2
(45) Date of Patent: Oct. 5, 2004

(54) REFLECTION TYPE ION ATTACHMENT MASS SPECTROMETRY APPARATUS

(75) Inventors: Yoshiki Hirano, Fuchu (JP); Yoshiro Shiokawa, Hachioji (JP)

(73) Assignee: Anelva Corporation, Fuchu (JP)

( * ) Notice: Subject to any disclaimer, the term of this patent is extended or adjusted under 35 U.S.C. 154(b) by 0 days.

(21) Appl. No.: 10/658,455

(22) Filed: Sep. 10, 2003

(65) Prior Publication Data

US 2004/0084616 A1 May 6, 2004

(30) Foreign Application Priority Data

Sep. 10, 2002 (JP) ..... 2002-264553
Mar. 31, 2003 (JP) ..... 2003-095456

(51) Int. Cl.[7] ..... H01J 49/10

(52) U.S. Cl. ..... 250/288; 250/423 R; 250/424

(58) Field of Search ..... 250/288, 423 R, 250/424

(56) References Cited

U.S. PATENT DOCUMENTS 4,649,278 A 3/1987 Chutjian et al.
4,933,551 A 6/1990 Bernius et al.
6,635,868 B2 * 10/2003 Shiokawa et al. ..... 250/288

FOREIGN PATENT DOCUMENTS

| | | |
|---|---|---|
| JP | 06-011485 | 1/1994 |
| JP | 2001-174437 | 6/2001 |
| JP | 2001-351567 | 12/2001 |
| JP | 2001-351568 | 12/2001 |
| JP | 2002-124208 | 4/2002 |
| JP | 2002-170518 | 6/2002 |

OTHER PUBLICATIONS

R.V. Hodges et al.., "Application of Alkali Ions in Chemical Ionization Mass Spectrometry", Analytical Chemistry, vol. 48, No. 5, pp. 825–829 (1976).
Daniel Bombick, et al., "Potassium Ion Chemical Ionization and Other Uses of an Alkali Thermionic Emitter in Mass Spectrometry", Analytical Chemistry, vol. 56, No. 3, pp. 396–402 (1984).
Toshihiro Fujii et al., "Chemical Ionization Mass Spectrometry with Lithium Ion Attachment to the Molecule", Analytical Chemistry, vol. 61, No. 9, pp. 1026–1029 (1989).
Toshihiro Fujii, "A Novel Method for Detection of Radical Species in the Gas Phase: Usage of Li+ Ion Attachment to Chemical Species", Chemical Physics Letters, vol. 191, No. 1.2, pp. 162–168 (1992).
T. Faye et al., "Sodium Ion Attachment Reactions in an Ion Trap Mass Spectrometer", Rapid Communications in Mass Spectrometry, vol. 13, pp. 1066–1073 (2000).

* cited by examiner

*Primary Examiner*—Nikita Wells
*Assistant Examiner*—Anthony Quash
(74) *Attorney, Agent, or Firm*—Burns, Doane, Swecker & Mathis, L.L.P.

(57) ABSTRACT

A reflection type ion attachment mass spectrometry apparatus is provided with a metal ion generation region, an attachment region and a mass spectrometry region. The metal ion generation region and the mass spectrometry region are formed as a common compartment and the attachment region is provided adjoining the common compartment. The attachment region has an electrostatic field generation unit for forming an electrostatic field in order to reflect the metal ions introduced from the metal ion generation region so as to guide them to the mass spectrometry region. Thereby, a trace ingredient can be detected with a high measurement sensitivity, the problems of disturbance of the mass spectrometer, deterioration of the metal ion emitter, the size of the apparatus, direct sampling, etc. are solved, and broad use in industry is possible.

17 Claims, 11 Drawing Sheets

REFLECTION TYPE ION ATTACHMENT MASS SPECTROMETRY APPARATUS

BACKGROUND OF THE INVENTION

1. Field of the Invention

The present invention relates to a reflection type ion attachment mass spectrometry apparatus, and more particularly, relates to a reflection type ion attachment mass spectrometry apparatus for measuring ingredients of a measured gas with a high sensitivity and high precision, and a method of reflection type ion attachment mass spectrometry.

2. Description of the Related Art

Ion attachment mass spectrometry (IAMS) is a method of ionizing the molecules of a measured gas without causing fragmentation (causing the generation of fragments, that is, breaking up the original molecules), making the ions of the molecules move to the mass spectrometry region, and analyzing their mass there. There are the following documents concerning apparatuses for working the ion attachment mass spectrometry method in the related art.

As patent documents, there are JP-A-6-11485, JP-A-2001-174437, JP-A-2001-351567, JP-A-2001-351568, JP-A-2002-124208, JP-A-2002-170518, U.S. Pat. No. 4,933,551, and U.S. Pat. No. 4,649,278. Further, as other documents, there are (1) Hodge, "Analytical Chemistry", 1976, vol. 48, no. 6, p. 825, (2) Bombick, "Analytical Chemistry", 1984, vol. 56, no. 3, p. 396, (3) Fujii, "Analytical Chemistry", 1986, vol. 61, no. 9, p. 1026, and (4) Fujii, "Chemical Physics Letters", 1992, vol. 191, no. 1.2, p. 162.

Referring to FIG. 22, the general configuration of an apparatus for ion attachment mass spectrometry of the related art will be explained in relation to the present invention. In FIG. 22, 1 indicates a metal ion generation region, 2 an attachment region, and 3 a mass spectrometry region. The metal ion generation region 1 and attachment region 2 form a common compartment having a common vacuum environment. A partition 6 is provided between the attachment region 2 and mass spectrometry region 3. The partition 6 is formed with an aperture 6*a*. The metal ion generation region 1 is provided with a metal ion emitter 4. In FIG. 22, 5 shows the path of movement of the metal ions and attached ions. The mass spectrometry region 3 is provided with a mass spectrometer 8 and is additionally provided with a vacuum pump 7.

The metal ion generation region 1, the attachment region 2, and the mass spectrometry region 3 all are at reduced pressures of not more than atmospheric pressure. In the metal ion generation region 1, a metal ion emitter 4 of an oxide of an alkali metal is heated to generate $Li^+$ and other positively charged metal ions. The metal ion emitter 4 is heated by supplying current by application of voltage by a not shown power source. The metal ions are transported to the attachment region 2 from the metal ion generation region 1 by an electric field. The measured gas (or sample gas) is introduced into the attachment region 2 by a measured gas introduction mechanism 30. The metal ions gently attach to locations with a concentration of charges of molecules of the measured gas. The molecules to which the metal ions are attached become positively charged ions as a whole, whereby attached ions (pseudo molecular ions) are generated.

At the time of attachment, the surplus energy is extremely small, so fragmentation does not occur. However, to prevent the metal ions from again disassociating from the attached ions (prevent the metal ions from detaching from the molecules of the measured gas), it is necessary to strip the surplus energy by having the ions collide with the ambient gas. To raise the efficiency of attachment, it is necessary to decelerate the metal ions emitted from the metal ion emitter 4 by the high voltage down to a translational energy of not more than 1 eV by colliding with the ambient gas. Even if the metal ions having a translational energy of at least 1 eV contact the molecules of the measured gas, almost all of them end up separating without attachment. To maximize these two effects, the general practice in an ion attachment mass spectrometry apparatus of the related art is to make the pressure in the attachment region 2 about 100 Pa. With a pressure of 100 Pa, the movement of the ions is not smooth and a problem arises in the quantitativeness of the results of measurement. Therefore, recently, methods of deceleration by an electric field and operation at a pressure of about 1 Pa in the attachment region are being developed.

The attached ions produced as explained above are again accelerated by the electric field, passed through the partition 6 with the aperture 6*a,* and transported to the mass spectrometry region 3. A Q-pole type mass spectrometer or other mass spectrometer 8 using electromagnetic force measures the attached ions separated in mass-charge ratio (mass number). The mass spectrometer normally can only operate by at a pressure of not more than $10^{-3}$ Pa, so a pressure difference is generated by the partition 6 with the aperture 6*a*. FIG. 22 shows a general example of the related art, but in different related arts, the differential regions exist in some cases, and do not exist in the other cases, and the number of vacuum pumps, etc. differ.

Therefore, in the past, an electron attachment mass spectrometry apparatus has also been proposed (U.S. Pat. No. 4,933,551). According to the electron attachment mass spectrometry apparatus disclosed in the above-mentioned document, electrons are made to attach to the neutral gas to form negative ions as a whole for mass spectrometry. Further, the technical idea has been proposed of slowing the speed of the electrons using an electric field and causing the electrons to attach to the gas molecules to create negative ions (U.S. Pat. No. 4,649,278). According to this document, a mirror electrostatic field is used to make the speed of the electrons zero or nearly zero and enable electrons to be attached to the gas.

The ion attachment mass spectrometry apparatuses of the related art all could ionize molecules without causing fragmentation and could correctly identify the ingredients of the measured gas (quantitative analysis). This surpasses other techniques. The scientific and industrial fields have large expectations vis-a-vis ion attachment mass spectrometry apparatuses. However, ion attachment mass spectrometry apparatuses have the weak point that the measurement sensitivity is insufficient and detection of trace ingredients is difficult. In particular, with the method of making the pressure of the attachment region 2 1 Pa for the purpose of improving the quantitativeness, the measurement sensitivity ends up deteriorating more, so the insufficient measurement sensitivity becomes a serious problem.

The reasons for the insufficient sensitivity will be explained in the following. As shown in FIG. 22, in the ion attachment mass spectrometry apparatus of the related art, the metal ion generation region 1, attachment region 2, and mass spectrometry region 3 are positioned adjoining each other in that order, while the metal ion emitter 4 and the mass spectrometer 8 are arranged on substantially the same straight line straddling the attachment region 2. Therefore, even if the metal ions generated from the metal ion emitter 4 change to attached ions in the attachment region 2, they are not changed in direction and proceed straight to the mass spectrometer 8 as they are. If there is no change in the translational energy on the way, the system of the conventional art of making the ions proceed straight is easiest and most reliable in control of the ions. However, in fact, the ions are greatly decelerated and accelerated in the process. Sufficient control has not been possible in the conventional art.

Specifically, for extracting and transporting the metal ions from the metal ion emitter 4, first, the translational energy of the metal ions is 10 to 20 eV, but at the attachment region 2, the ions are decelerated to less than 1 eV to improve the attachment efficiency. Next, the attached ions produced are accelerated and again transported to the mass spectrometer 8 by a translational energy of 10 to 20 eV. If decelerated sharply in this way, the horizontal direction translational energy component originally held by the individual ions is strongly manifested and the ions end up spreading broadly spatially. It is extremely difficult to again accelerate and concentrate the ions spreaded out spatially in the substantially stopped state. Therefore, the actually detected attached ions become an order of magnitude smaller than the total amount of the attached ions produced.

In particular, when improving the quantitativeness by deceleration by only an electrostatic field without using collision with a gas, this problem becomes more serious. Only with an electrostatic field, decelerating and stopping the ions, then accelerating them again in the same direction is inherently impossible. This becomes possible only by using an electric field changing along with time, but the process of transport and attachment becomes intermittent, so the time averaged efficiency drops sharply. For example, in U.S. Pat. No. 4,649,278, an electric field changing over time is used.

As explained above, the problem of ion control in deceleration and acceleration while advancing is a major reason for insufficient measurement sensitivity in an ion attachment mass spectrometry apparatus of the conventional art.

In an ion attachment mass spectrometry apparatus of the conventional art where the metal ion emitter 4 and the mass spectrometer 8 are arranged facing each other on the same line, there were the following problems (1) to (4) in addition to the above problem of insufficient measurement sensitivity.

(1) The mass spectrometer 8 is easily disturbed by light or neutral particles etc. from the metal ion emitter 4. (2) The metal ion emitter 4 easily deteriorates. (3) The apparatus is large in size. (4) Direct monitoring is difficult.

The above problems will be explained in more detail. Light, neutral particles, etc. are also produced from the metal ion emitter 4 heated to a high temperature, but these do not carry a charge, so they proceed directly, enter the facing mass spectrometer 8, and cause a rise in the background level, contamination of the electrodes, etc. In particular, a general Q-pole type mass spectrometer used as the mass spectrometer 8 is comprised of four axially parallel poles, so the light or neutral particles proceeding directly from the surface, that is, flying in parallel to the axis, enter deep into the Q-pole type mass spectrometer and cause an extremely serious problem.

The metal ion emitter 4 is positioned at spatially the same region as the attachment region 2 to which the measured gas is introduced. Therefore, the surface of the metal ion emitter heated to a high temperature is continuously exposed to the measured gas, the measured gas reacts at the surface of the metal ion emitter, the products deposit on the surface of the metal ion emitter, and the surface is etched and deterioration of the metal ion emitter 4 is caused.

Further, as the structure of the apparatus, the metal ion generation region 1, attachment region 2, and mass spectrometry region 3 are aligned in that order, so the apparatus becomes larger as a whole. The attachment region 2 in which the measured gas is introduced is positioned at the center of the apparatus, so direct sampling where the measured part is connected directly to the attachment region without using piping which might cause a change in the ingredients of the measured gas, is difficult to implement.

Further, in the electron attachment mass spectrometry method disclosed in U.S. Pat. No. 4,933,551, steps to decelerate the electron are adopted. However, the electron attachment mass spectrometry method has the characteristic that the electrons attach to only the negative gas which easily becomes negative ions and in almost all cases fragmentation occurs after electron attachment. In the ion attachment mass spectrometry method, there is no such characteristic. This is a completely different ionization method. Further, with electron attachment, the electrons to be attached penetrate to electron orbit of the gas, while with ion attachment, the metal ions make a gentle bonding with the gas. Due to the above, the electron attachment mass spectrometry method is an extremely special method of analysis only for some scientific research, while the ion attachment mass spectrometry method can be considered as an extremely general method of analysis for use in a broad spectrum of industries.

From another viewpoint, in the ion attachment mass spectrometry apparatus of the related art shown in FIG. 22, the pressure of the metal ion generation region and the pressure of the attachment region become substantially the same and the problem arises that the metal ions emitted from the metal ion emitter become harder to decelerate. Therefore, it is desirable to configure the apparatus so as to enable a sufficient difference to be given between the pressure of the metal ion generation region and the pressure of the attachment region and to enable the metal ions emitted from the metal ion emitter to be sufficiently decelerated on the way toward the attachment region.

OBJECTS AND SUMMARY

An object of the present invention is to provide a reflection type ion attachment mass spectrometry apparatus which can detect trace ingredients with a high measurement sensitivity, can solve or minimize the problems of disturbance of the mass spectrometer, deterioration of the metal ion emitter, the size of the apparatus, and the direct sampling, and can be widely used in industry as a general analytical method.

Another object of the present invention is to provide a reflection type ion attachment mass spectrometry apparatus which can make the pressure of the metal ion generation region and the pressure of the attachment region different so as to sufficiently decelerate the metal ions.

The reflection type ion attachment mass spectrometry apparatus according to embodiments of the present invention is configured as follows for achieving the above object.

A first reflection type ion attachment mass spectrometry apparatus is an apparatus causing positively charged metal ions generated in a metal ion generation region to attach to molecules of a measured gas in an attachment region to generate attached ions and then performing mass spectrometry on the attached ions in a mass spectrometry region, wherein the metal ion generation region and the mass spectrometry region are formed as a common region or compartment, the attachment region is provided adjoining the common region, and the attachment region is provided with an electrostatic field generating means for forming an electrostatic field for reflecting the metal ions introduced from the metal ion generation region to the attachment region so as to guide them to the mass spectrometry region.

Preferably, a translational energy of the metal ions is reduced by reflection.

More preferably, the attached ions are accelerated and concentrated by the electrostatic field reflecting the metal ions.

More preferably, the electrostatic field generating means forms an electrostatic field without using a grid where the metal ions or the attached ions pass.

Preferably, a correction field is superposed on the electrostatic field to adjust the paths of the metal ions and attached ions.

Preferably, the distribution of intensity of the electrostatic field is of axially symmetric ellipsoid.

Alternatively, the distribution of intensity of the electrostatic field is spherical.

Preferably, a partition having an aperture for introducing the metal ions from the metal ion generation region to the attachment region and an aperture for transporting the attached ions from the attachment region to the mass spectrometry region is provided between the attachment region and the region of the metal ion generation region and the mass spectrometry region.

Alternatively, a partition having an aperture for introducing the metal ions from the metal ion generation region to the attachment region and transporting the attached ions from the attachment region to the mass spectrometry region is provided between the attachment region and the region of the metal ion generation region and the mass spectrometry region.

Here, the reflection type ion attachment mass spectrometry apparatus according to an embodiment of the present invention explained above will be explained with respect to its actions. The problems explained in the section on the related art are due to the fact that the metal ion emitter and mass spectrometer are positioned on substantially the same straight line and the metal ions and attached ions proceed straight. On the contrary, in the embodiments of the present invention, the metal ion emitter and mass spectrometer are arranged in the same compartment. Further, the metal ions are reflected in the attachment region to generate attached ions in the process of reflection, and the returning attached ions are concentrated and led to the mass spectrometer. Due to this, it is possible to find a basic solution to the above problems.

The characteristic behavior in an electrostatic field is that ions having the same translational energy fly over completely the same path without regard to the mass. This can be explained as follows. Heavy ions are slower in actual speed compared with light ions even with the same translational energy. Therefore, the time of passage through the electrostatic field becomes longer and the impulse received from the electrostatic field becomes stronger. However, since the mass is heavier, the acceleration (=force/mass) finally becomes the same. The path becomes completely the same as that of light ions. In the electrostatic field, the metal ions become attached ions midway and the mass of the ions increases, but there is no change in the path at all.

In the configurations of the present invention, the above problems are solved based on the actions and effects (a) to (g) explained below:

(a) When reflecting metal ions at an acute angle by an electrostatic field, since the metal ions are sufficiently decelerated, the attachment efficiency becomes extremely high.

(b) Since the attached ions generated at the time of deceleration are accelerated in the opposite direction, ion control of good precision becomes possible.

(c) Since, by suitably shaping the electrostatic field, even if the metal ions spread spatially, the attached ions will be concentrated over the reverse path, so high efficiency detection becomes possible.

(d) Since the metal ion emitter and the mass spectrometer do not face each other, the light or neutral particles from the metal ion emitter cannot enter the mass spectrometer and normal mass spectrometry becomes possible at all times.

(e) Since the metal ion emitter is the same compartment as the mass spectrometer which should be at not more than $10^{-3}$ Pa, the contact with the measured gas is greatly reduced and there is no longer deterioration of the metal ion emitter.

(f) Since there is no longer an independent metal ion generation region, the apparatus can be made smaller in size.

(g) Since the attachment region is positioned at the front end of the apparatus, direct sampling by directly connecting the measured part is possible.

Next, a second reflection type ion attachment mass spectrometry apparatus is an apparatus causing positively charged metal ions generated in a metal ion generation region to attach to molecules of a measured gas in an attachment region to generate attached ions and then performing mass spectrometry of the attached ions in a mass spectrometry region, having a reflection type structural member introducing the metal ions to the attachment region, causing the metal ions to attach to molecules of measured gas to generate attached ions while reflecting the metal ions at the attachment region, and ejecting the attached ions from the attachment region, and performing mass spectrometry on the attached ions by a mass spectrometer, an aperture by which the metal ions enter the attachment region and an aperture by which the attached ions are ejected from the attachment region being the same common aperture.

Preferably, a path of the metal ions before entering the common aperture and a path of the attached ions after departing from the common aperture are separated by an electric field or magnetic field.

Preferably, the distribution of the electric field of the attachment region is made spherically symmetric with respect to the common aperture.

Preferably, a supersonic jet is formed in the attachment region.

The reflection type ion attachment mass spectrometry apparatus of the present invention described above has the following action. In such low densities of the metal ions and attached ions as those in an ion attachment mass spectrometry apparatus, they have negligible effect on each other even if they pass by at the same position. Therefore, the structure of a reflection type ion attachment mass spectrometry apparatus is employed, the attachment region, metal ion generation region, and mass spectrometry region are arranged in that order, and the metal ions and attached ions are made to pass through a single same aperture (two-ion passing aperture) at the boundary of the attachment region and metal ion generation region.

In the metal ion generation region, the paths of the metal ions and attached ions are separated by the electric field or the magnetic field and the metal ion emitter and mass spectrometer are prevented from interfering with each other. In the attachment region, due to the use of a spherical electric field, the metal ions ejected from the two-ion passing aperture return to the same location as the attached ions.

Further, as a alternative structure of the attachment region, a two-ion passing aperture of a skimmer type is inserted into the Mach disk inside which the supersonic flow is generated as in the same way as the supersonic type ion attachment mass spectrometry apparatus.

In the ion attachment mass spectrometry apparatus having a reflection structure, the metal ions can be sufficiently decelerated, the efficiency of generation of the attached ions can be raised, and the measurement sensitivity can be increased. By employing the structure of a two-ion passing aperture, it becomes possible to give a sufficient pressure difference. This is effective for measurement at a high pressure. On the contrary to this, in the case of a two-aperture structure, this becomes effective at a low pressure due to not disturbing the flight of the ions.

According to the first aspect of the present invention explained above, the ion attachment mass spectrometry apparatus forms the metal ion generation region and mass spectrometry region as a common region or compartment, provides the attachment region adjoining the common compartment, and is provided with an electrostatic generating unit for guiding the metal ions to the mass spectrometry region by reflection, so it is possible to detect trace ingredients by a high measurement sensitivity, and to solve the problems of disturbance of the mass spectrometer, deterioration of the metal ion emitter, apparatus size, direct sampling, etc., and realize broad applications in industry. According to the second aspect of the invention, in addition to the above advantageous effects of a reflection type ion attachment mass spectrometry apparatus, using a single aperture as a two-ion passing aperture is particularly effective for measurement of a sample gas with a high gas pressure. It is possible to make the pressure of the metal ion generation region and pressure of the attachment region different and sufficiently decelerate the metal ions.

BRIEF DESCRIPTION OF THE DRAWINGS

These and other objects and features of the present invention will become clearer from the following description of the preferred embodiments given with reference to the attached drawings, in which.

DESCRIPTION OF THE PREFERRED EMBODIMENTS

Figure 1:
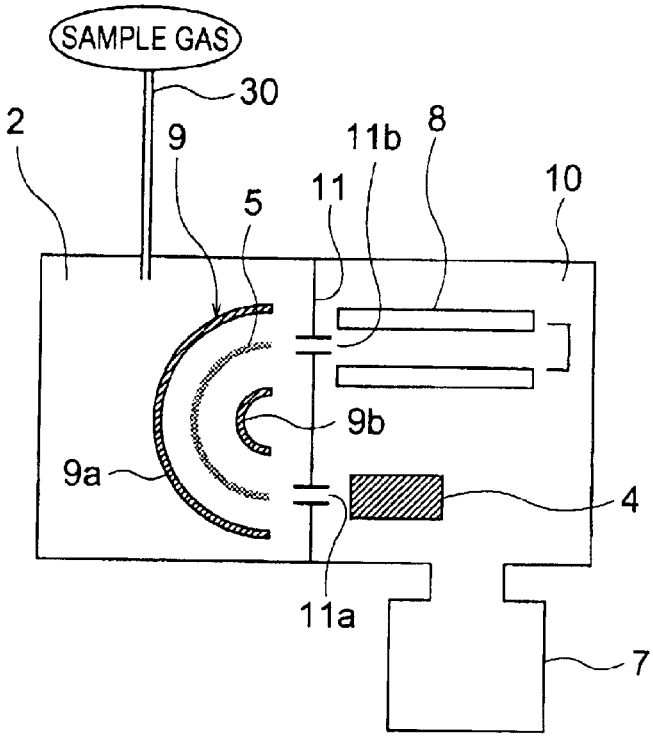
FIG. 1 is a sectional view schematically showing the internal structure of a reflection type ion attachment mass spectrometry apparatus according to a first embodiment of the present invention.
Figure 22:
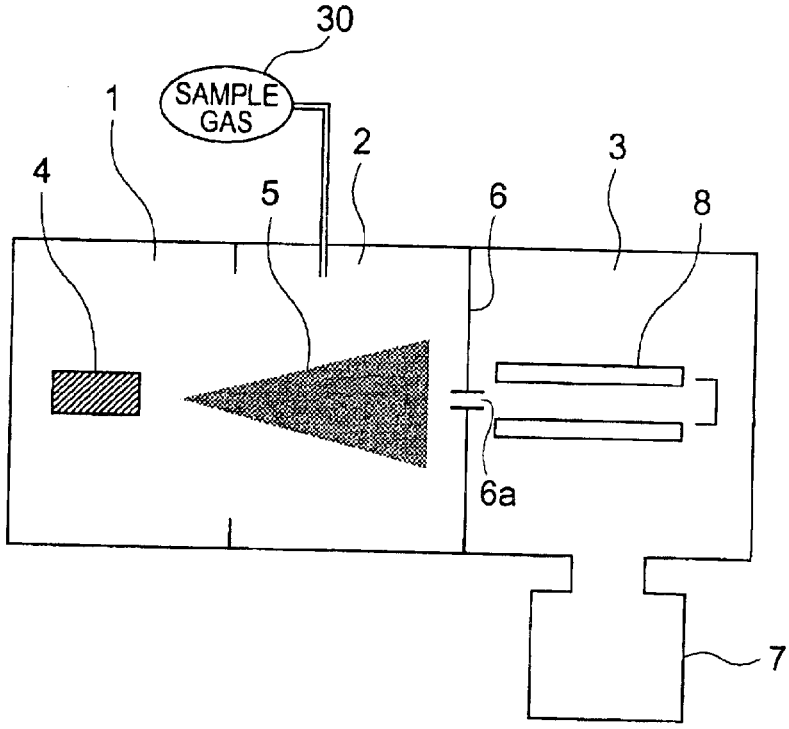
FIG. 22 is a sectional view schematically showing the internal structure of a reflection type ion attachment mass spectrometry apparatus according to the related art.

In the following, preferred embodiments of the present invention will be explained with reference to the attached drawings. FIG. 1 is a vertical sectional view schematically showing the internal structure of a reflection type ion attachment mass spectrometry apparatus according to a first embodiment of the present invention. In FIG. 1, components of substantially the same as the components explained in FIG. 22 are assigned the same reference numerals.

In FIG. 1, 2 is an attachment region, and 10 is a region wherein the metal ion generation region and the mass spectrometry region are formed in a common region or compartment. The region 10 is referred to as a common compartment 10. The attachment region 2 is formed as an independent chamber at the left end of the apparatus in the figure. A partition 11 having two apertures 11*a* and 11*b* is provided between the attachment region 2 and the common compartment 10. The partition 11 separates the two regions. The common compartment 10 is provided with a metal ion emitter 4 and mass spectrometer 8. The metal ion emitter 4 is arranged facing the aperture 11*a*, while the mass spectrometer 8 is arranged facing the aperture 11*b*. The positively charged metal ions emitted from the metal ion emitter 4 pass through the aperture 11*a* and enter the attachment region 2. The attachment region 2 is provided with a double-wall semispherical reflector 9. Reference numeral 5 in the reflector 9 in the attachment region 2 indicates the path of movement of the metal ions and attached ions in the reflector 9 in the attachment region 2. The metal ions entering the attachment region 2 enter the inlet of the reflector 9 and move inside the reflector 9. The common compartment 10 is additionally provided with a vacuum pump 7. The sample gas to be measured is introduced into the reflector 9 of the attachment region 2 by a sample gas introduction mechanism 30.

The metal ion generation and mass spectrometry common compartment 10 and attachment region 2 are formed between them with a pressure difference by the two-aperture partition 11. A pressure difference by the two-aperture partition 11 is made between the metal ion generation and mass spectrometry common compartment 10 and attachment region 2. The attachment region 2 is filled with the sample gas and reaches a pressure of about 1 Pa, while the pressure of the common compartment 10 of the metal ion generation and mass spectrometry reaches about $10^{-3}$ Pa. The metal ions used are for example $Li^+$. The average free flight of $Li^+$ at $10^{-3}$ Pa is about 10 m and the average free flight at 1 Pa is about 10 mm, so the ions engage in free flight proceeding without colliding with the ambient gas in all regions.

The metal ion emitter 4 is supplied with a bias voltage of about 15V by a not shown power source, so the metal ions emitted from the metal ion emitter 4 pass through the aperture 11*a* of the partition 11 with a translational energy of about 15 eV and are transported and introduced to the attachment region 2. The inside and outside semispheres 9*a* and 9*b* of the double-wall semispherical reflector 9 are supplied with voltage whereby an electrostatic field is formed enabling passage of ions of a translational energy of about 15 eV. Therefore, the metal ions pass through the double-wall semispherical reflector 9, but on the way attach to the measured gas to form attached ions. Even if the metal ions are changed to the attached ions, the path of the ions does not change. The ions proceed along the initial path as they are, pass through the aperture 11*b* of the partition 11, are transported to the mass spectrometer 8, and are separated in mass by the mass spectrometer 8. This electrostatic field has the function of concentrating the ions entering the attachment region 2 with a broad angle.

According to the first embodiment, the metal ions fly with a translational energy of about 15 eV at all times, so no improvement in the attachment efficiency due to deceleration can be expected. However, there is an effect in solving all problems except for the above-mentioned (a) and (b).

Although not specifically illustrated, this embodiment includes a control system and a power source for controlling and powering the respective components.

Figure 2:
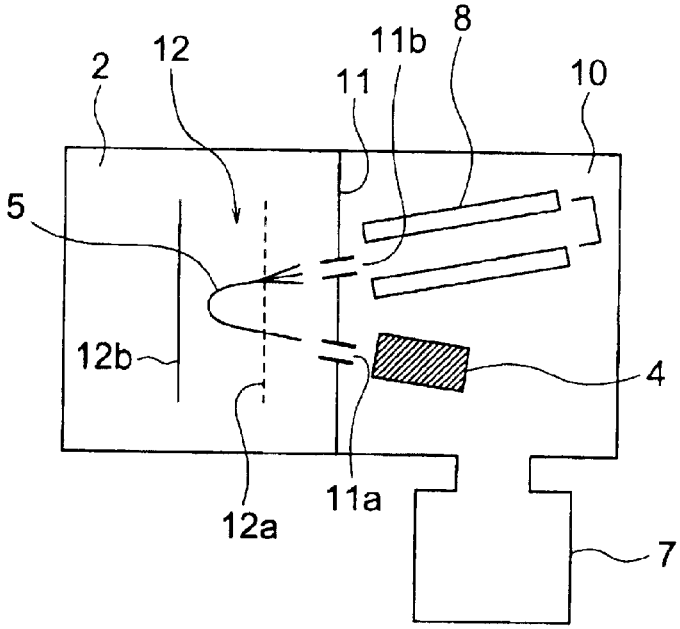
FIG. 2 is a sectional view schematically showing the internal structure of a reflection type ion attachment mass spectrometry apparatus according to a second embodiment of the present invention.

Next, a second embodiment of the present invention will be explained with reference to FIG. 2. FIG. 2 schematically shows the internal structure of a reflection type ion attachment mass spectrometry apparatus according to the second embodiment of the present invention. In FIG. 2, components of substantially the same as components explained in FIG. 1 are assigned the same reference numerals and detailed explanations are omitted. Below, the characteristic features of the second embodiment will be explained.

As shown in FIG. 2, in the second embodiment, the attachment region 2 is provided with a reflector 12 configured to create a parallel electric field. The metal ion emitter 4 and mass spectrometer 8 arranged in the common compartment 10 are inclined so that the direction of emission of the metal ions emitted from the metal ion emitter 4 and the axial direction of the mass spectrometer 8 are oriented toward a single point at the attachment region side. Two apertures 11*a* and 11*b* formed at the partition 11 are formed so as to tilt the direction of guidance of the metal ions and attached ions corresponding to the inclination of the metal ion emitter 4 and the mass spectrometer 8. The rest of the configuration is the same as the configuration explained in the first embodiment.

In the parallel electric field reflector 12, a parallel electrostatic field is formed between the grid 12*a* on the right side and the plate 12*b* on the left side. The grid 12*a* is a mesh like member made of wire or a plate member having a large number of apertures. In the reflector 12, due to the electrostatic field, the positively charged ions receive force in the right direction in FIG. 2. The metal ions emitted toward the left side somewhat upward from the metal ion emitter 4 are decelerated by the electrostatic field and reflected by an acute angle of about 30°. At the time of reflection, the velocity component of horizontal direction becomes completely zero and only the vertical direction component remains. If the initial translational speed is E, the translational energy remaining at the time of reflection becomes $E \cdot \sin((30°)/2)$. The attached ions generated in the reflector 12 return toward the right side with somewhat upward velocity by the same electrostatic field and are transported to the mass spectrometer 8.

According to the second embodiment, compared with the first embodiment, the structure is simpler and the metal ions are decelerated, so an improvement in the attachment efficiency can be expected. On the other hand, there is no function of concentrating the ions. That is, except for the above-mentioned (c), there is an effect on solving all of the problems.

Although not specifically illustrated, this embodiment includes a control system and a power-source for controlling and powering the respective components.

Figure 3:
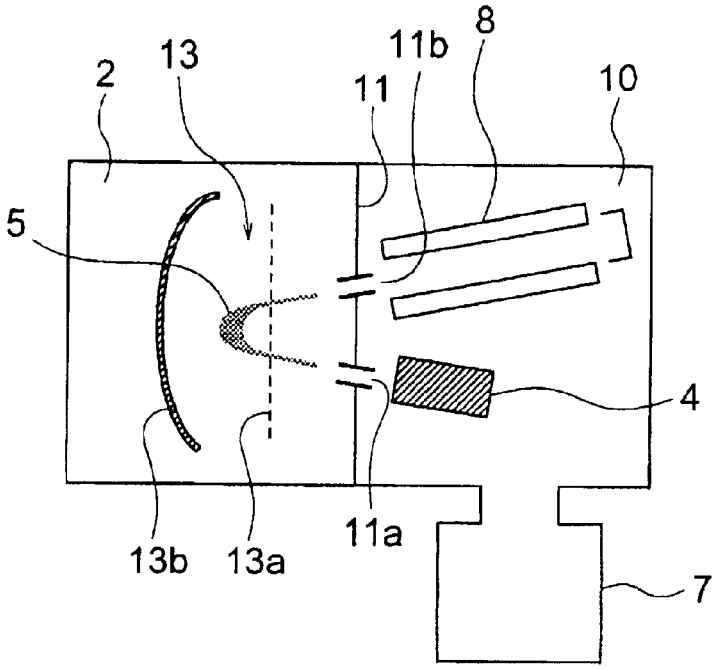
FIG. 3 is a sectional view schematically showing the internal structure of a reflection type ion attachment mass spectrometry apparatus according to a third embodiment of the present invention.

Next, a third embodiment of the present invention will be explained with reference to FIG. 3. FIG. 3 schematically shows the internal structure of a reflection type ion attachment mass spectrometry apparatus according to the third embodiment of the present invention. In FIG. 3, components of substantially the same as components explained in FIG. 1 and FIG. 2 are assigned the same reference numerals and detailed explanations are omitted. Below, the characteristic features of the third embodiment will be explained.

As shown in FIG. 3, in the third embodiment, the attachment region 2 is provided with a reflector 13 configured to generate a curved electric field. The rest of the configuration is the same as the configuration explained in the second embodiment.

In the curved electric field reflector 13, an electrostatic field having a 3D curved surface (for example, a parabolic surface) is formed between the right side grid 13*a* and the left side curved plate 13*b*. The positively charged ions entering the region of this electrostatic field receive force at the right side somewhat in the center direction. The attached ions generated on the way of reflection move toward the right somewhat upward by the electrostatic field. At this time, since the ions head toward the somewhat center direction, they are efficiently transported to the mass spectrometer 8.

According to the third embodiment, compared with the second embodiment, there is the function of concentrating the ions. That is, there is an effect on elimination of all of the problems (a) to (g).

Although not specifically illustrated, this embodiment includes a control system and a power-source for controlling and powering the respective components.

Figure 4:
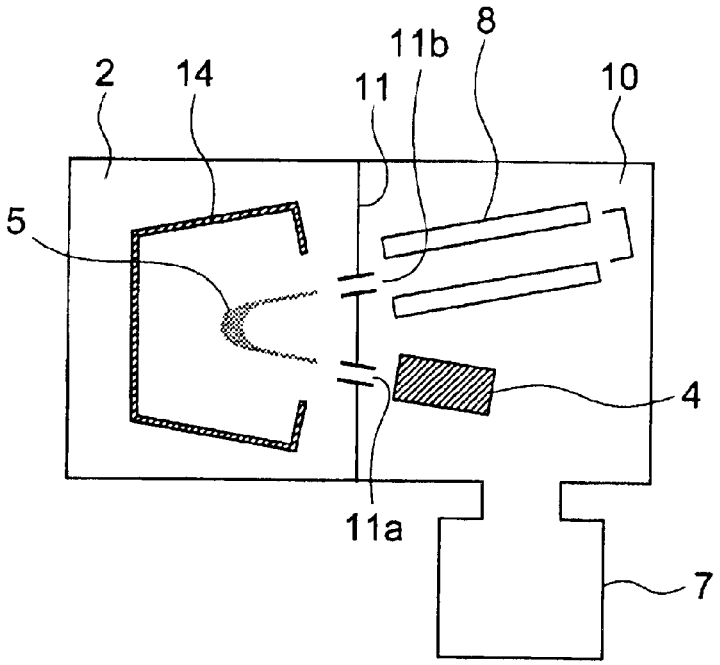
FIG. 4 is a sectional view schematically showing the internal structure of a reflection type ion attachment mass spectrometry apparatus according to a fourth embodiment of the present invention.

Next, a fourth embodiment of the present invention will be explained with reference to FIG. 4. FIG. 4 schematically shows the internal structure of a reflection type ion attachment mass spectrometry apparatus according to the fourth embodiment of the present invention. In FIG. 4, components of substantially the same as components explained in FIG. 1 and FIG. 2 are assigned the same reference numerals and detailed explanations are omitted. Below, the characteristic features of the fourth embodiment will be explained.

As shown in FIG. 4, in the fourth embodiment, the attachment region 2 is provided with a gridless curved electric field reflector 14. The rest of the configuration is the same as the configuration of the second embodiment etc. In the gridless curved electric field reflector 14, there is no grid through which metal ions or attached ions can pass, but an electrostatic field having a 3D curved surface similar to that of FIG. 3 is formed by the leakage electric field.

According to the fourth embodiment, compared with for example the third embodiment, since there is no grid, the structure becomes simpler. Further, with a grid, products of the Li or sample gas (measured gas) will deposit on the surface and may result in charge up and a drop in sensitivity. This inconvenience is eliminated in the present embodiment.

Although not specifically illustrated, this embodiment includes a control system and a power-source for controlling and powering the respective components.

Figure 5:
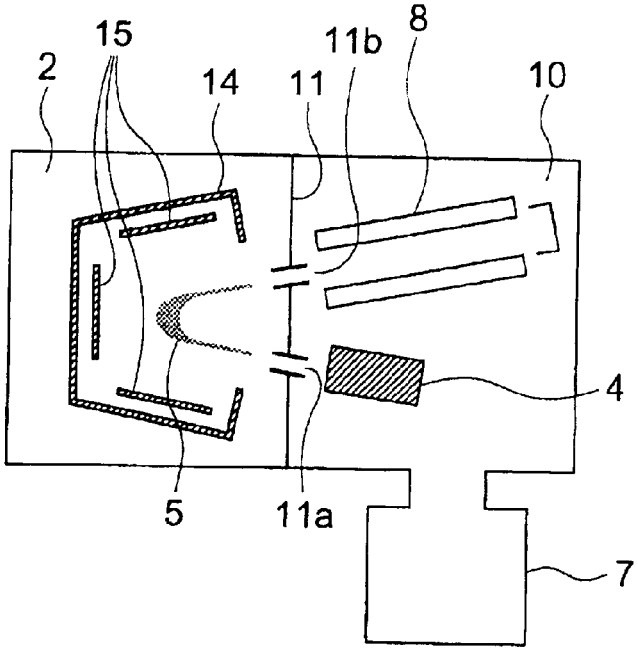
FIG. 5 is a sectional view schematically showing the internal structure of a reflection type ion attachment mass spectrometry apparatus according to a fifth embodiment of the present invention.

Next, a fifth embodiment of the present invention will be explained with reference to FIG. 5. FIG. 5 schematically shows the internal structure of a reflection type ion attachment mass spectrometry apparatus according to the fifth embodiment of the present invention. In FIG. 5, components of substantially the same as components explained in FIG. 1, FIG. 2, etc. are assigned the same reference numerals and detailed explanations are omitted. Below, the characteristic features of the fifth embodiment will be explained.

As shown in FIG. 5, in the fifth embodiment, the attachment region 2 is provided with a gridless curved electric field reflector 14. Further, the reflector 14 is provided inside it with for example three correction electrodes 15. The fifth embodiment is a modification of the fourth embodiment. The rest of the configuration is the same as the configuration explained in the fourth embodiment.

The correction electrodes 15 are supplied with a very small voltage. A correction electric field due to the correction electrodes 15 is superposed on the electrostatic field due to the reactor 14. Due to this, the paths of movement of metal ions and attached ions are adjusted. For example, when the path of the attached ions heading toward the mass spectrometer 8 deviates upward in FIG. 5, a positive voltage is supplied by the correction electrode 15 at the top side to make the path of the attached ions move downward. Further, when the concentration of the attached ions is insufficient, a negative voltage is supplied by the correction electrode 15 at the left side to strengthen the effect of concentration of the attached ions.

According to the configuration of the fifth embodiment, it is possible to not only adjust the path of the ions, but also monitor the path to judge whether adjustment is necessary. If two-dimensionally scanning is performed, the path of the attached ions can be changed by the correction electrodes 15 and an image using the detection signal is displayed as luminance. Adjustment is unnecessary if the bright parts in the image concentrate at the center. Adjustment is necessary if the bright parts offset from the center or broad.

According to the fifth embodiment, there is the advantage that measurement is possible at the maximum sensitivity at all times.

Although not specifically illustrated, this embodiment includes a control system and a power-source for controlling and powering the respective components.

Figure 6:
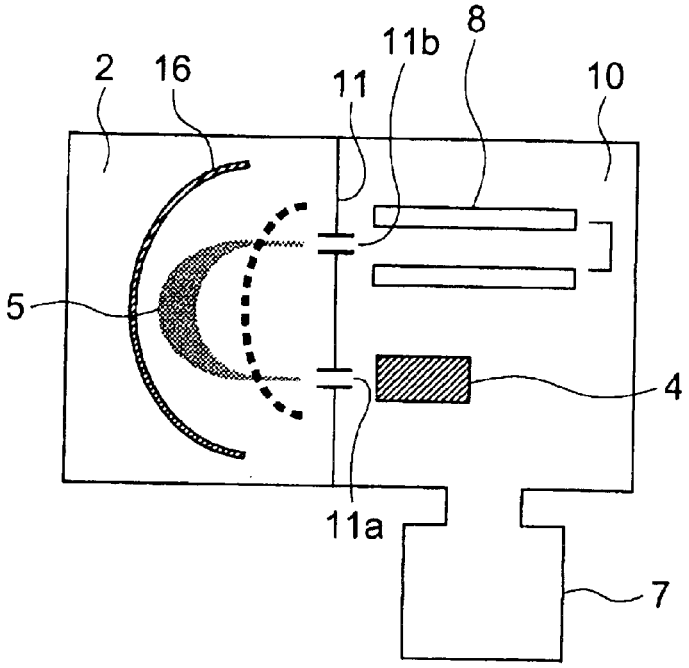
FIG. 6 is a sectional view schematically showing the internal structure of a reflection type ion attachment mass spectrometry apparatus according to a sixth embodiment of the present invention.

Next, a sixth embodiment of the present invention will be explained with reference to FIG. 6. FIG. 6 schematically shows the internal structure of a reflection type ion attachment mass spectrometry apparatus according to the sixth embodiment of the present invention. In FIG. 6, components of substantially the same as components explained in FIG. 1 and FIG. 3 are assigned the same reference numerals and detailed explanations are omitted. The sixth embodiment is a modification comprised of the combination of the first and third embodiments. Below, the characteristic features of the sixth embodiment will be explained.

As shown in FIG. 6, in the sixth embodiment, the attachment region 2 is provided with a reflector 16 configured to generate an axially symmetric elliptical electric field. The result of the configuration is the same as that explained above. The reflector 16 is comprised of an inside and outside electrode. The inside electrode is grid shaped and allows the passage of ions.

The point where the metal ions enter the attachment region 2 and the point where the attached ions are ejected from the attachment region 2 match with the two focal points in the axially symmetric ellipsoid.

When the ions are mirror-reflected by the inside surface of a axially symmetric ellipsoid ideally, it is known that the light entering from one focal point will be concentrated at other focal points no matter what the angle is. Therefore, according to the sixth embodiment, compared with for example the third embodiment, there is the advantage that the concentrating efficiency of ions becomes higher.

Although not specifically illustrated, this embodiment includes a control system and a power-source for controlling and powering the respective components.

Figure 7:
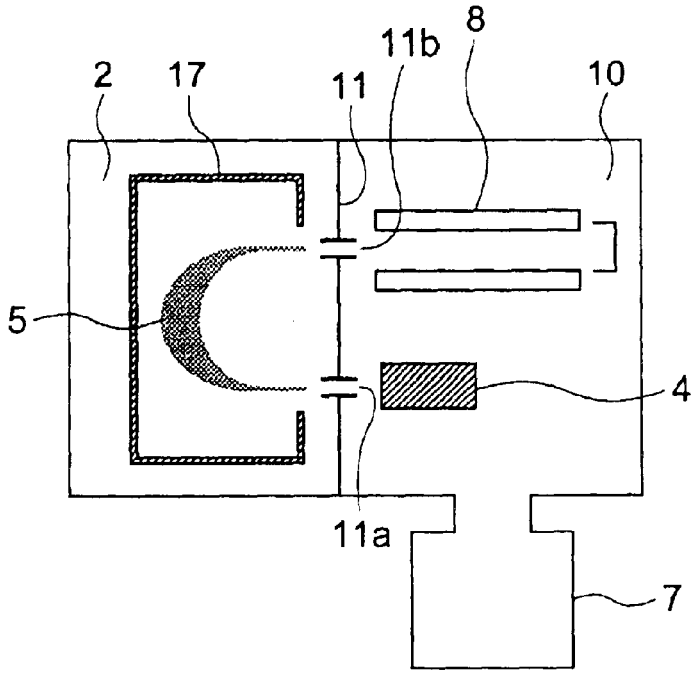
FIG. 7 is a sectional view schematically showing the internal structure of a reflection type ion attachment mass spectrometry apparatus according to a seventh embodiment of the present invention.

Next, a seventh embodiment of the present invention will be explained with reference to FIG. 7. FIG. 7 schematically shows the internal structure of a reflection type ion attachment mass spectrometry apparatus according to the seventh embodiment of the present invention. In FIG. 7, components of substantially the same as components explained in FIG. 1 etc. are assigned the same reference numerals and detailed explanations are omitted. Below, the characteristic features of the seventh embodiment will be explained.

As shown in FIG. 7, in the seventh embodiment, the attachment region 2 is provided with a gridless reflector 17 which forms an axially symmetric elliptical electric field. The result of the configuration is the same as the configuration of the sixth embodiment. In this embodiment, an axially symmetric elliptical electrostatic field similar to the electrostatic field explained in FIG. 6 is formed by the leakage electric field of the reflector 17. According to this embodiment, compared with the sixth embodiment, since there is no grid, there are the advantages that the structure becomes simple and there is an advantage in terms of sensitivity.

Although not specifically illustrated, this embodiment includes a control system and a power-source for controlling and powering the respective components.

Figure 8:
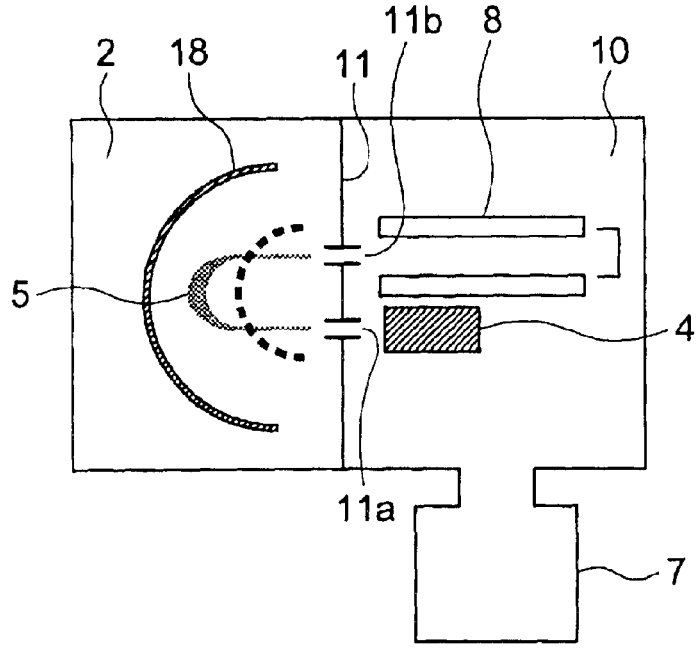
FIG. 8 is a sectional view schematically showing the internal structure of a reflection type ion attachment mass spectrometry apparatus according to an eighth embodiment of the present invention.

Next, an eighth embodiment of the present invention will be explained with reference to FIG. 8. FIG. 8 schematically shows the internal structure of a reflection type ion attachment mass spectrometry apparatus according to the eighth embodiment of the present invention. In FIG. 8, components of substantially the same as components explained in FIG. 1 etc. are assigned the same reference numerals and detailed explanations are omitted. Below, the characteristic features of the eighth embodiment will be explained.

As shown in FIG. 8, in the eighth embodiment, the attachment region 2 is provided with a reflector 18 formed so as to generate a spherical electric field. The rest of the configuration is the same as the configuration explained in FIG. 6. In the configuration of the eighth embodiment, the point where the metal ions enter the attachment region 2 and the point where the attached ions are ejected from the attachment region 2 are closer to the center. According to the eighth embodiment, there is the advantage that the reflector is easier to fabricate.

Although not specifically illustrated, this embodiment includes a control system and a power-source for controlling and powering the respective components.

Figure 9:
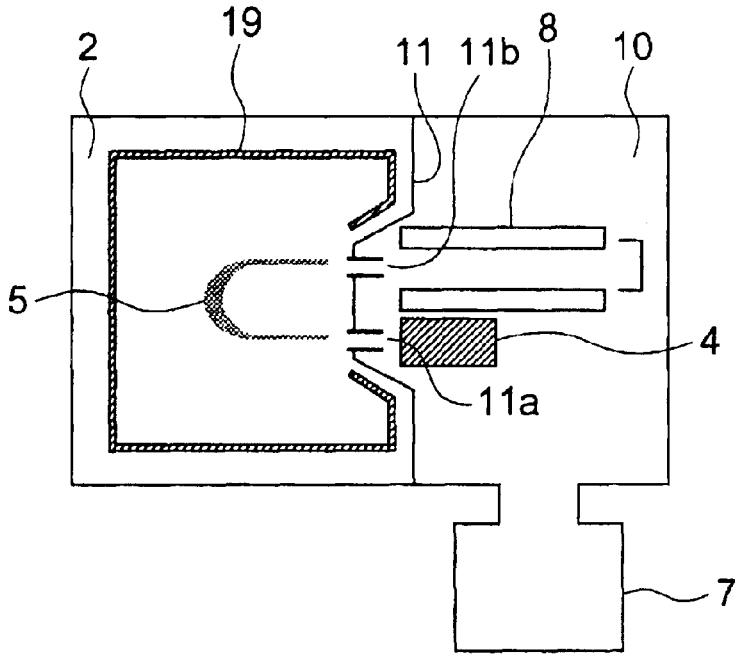
FIG. 9 is a sectional view schematically showing the internal structure of a reflection type ion attachment mass spectrometry apparatus according to a ninth embodiment of the present invention.

Next, a ninth embodiment of the present invention will be explained with reference to FIG. 9. FIG. 9 schematically shows the internal structure of a reflection type ion attachment mass spectrometry apparatus according to the ninth embodiment of the present invention. In FIG. 9, components substantially the same as components explained in FIG. 1 etc. are assigned the same reference numerals and detailed explanations are omitted. Below, the characteristic features of the ninth embodiment will be explained.

As shown in FIG. 9, in the ninth embodiment, a reflector 19 configured to produce a gridless spherical electric field is provided. Due to the reflector 19, a spherical electrostatic field similar to that explained in FIG. 8 is formed by the leakage field. The rest of the configuration is the same as that explained in the eighth embodiment. According to this embodiment, there is no grid, so the structure is simpler. This is advantageous in terms of the sensitivity.

Although not specifically illustrated, this embodiment includes a control system and a power-source for controlling and powering the respective components.

Figure 10:
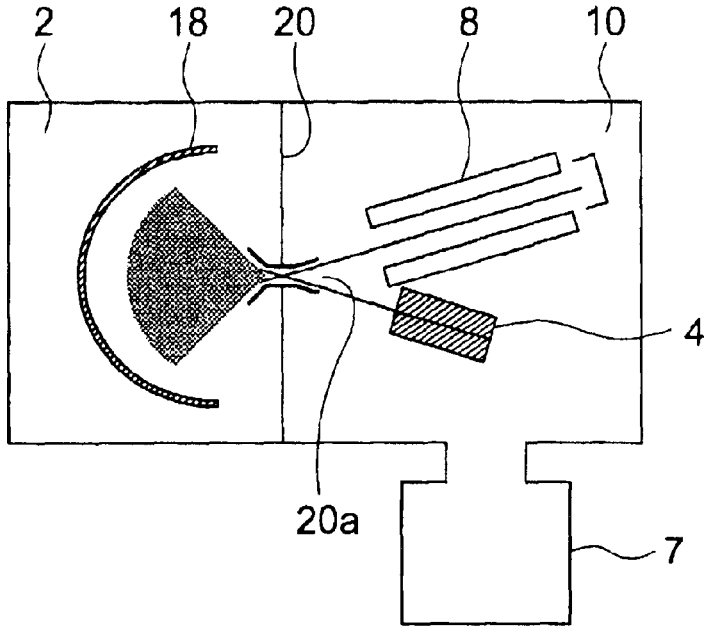
FIG. 10 is a sectional view schematically showing the internal structure of a reflection type ion attachment mass spectrometry apparatus according to a 10th embodiment of the present invention.

Next, a 10th embodiment of the present invention will be explained with reference to FIG. 10. FIG. 10 schematically shows the internal structure of a reflection type ion attachment mass spectrometry apparatus according to the 10th embodiment of the present invention. In FIG. 10, components of substantially the same as components explained in FIG. 1, FIG. 8, etc. are assigned the same reference numerals and detailed explanations are omitted. Below, the characteristic features of the 10th embodiment will be explained.

As shown in FIG. 10, in the 10th embodiment, the attachment region 2 is provided with a reflector 18 formed so as to generate a spherical electric field. A partition 20 having a single common aperture (two-ion passing aperture) 20*a* is provided between the attachment region 2 and the common compartment 10. The point where the metal ions enter from the metal ion emitter 4 to the attachment region 2 and the point where the attached ions are ejected from the attachment region 2 to the mass spectrometry region 8 are at the same position. These actions are performed at the single aperture 20*a* of the common-aperture partition 20. The rest of the configuration is basically the same as the configuration of the eighth embodiment. However, the metal ion emitter 4 and the mass spectrometer 8 are arranged in postures slanted as shown in the figure so that the direction of emission of ions from the metal ion emitter 4 and the center axis of the mass spectrometer 8 are oriented toward the common aperture 20*a*.

According to the 10th embodiment, there is a single aperture 20*a* of the partition 20. This is advantageous for creation of a pressure difference. Further, since the lines of electrical force are oriented in the direction of the center aperture (emission aperture) 20*a* everywhere, part of the attached ions which strike the ambient gas and lose translational energy without making free flight can also be concentrated at the single two-ion passing aperture and good precision measurement can be performed.

Although not specifically illustrated, this embodiment includes a control system and a power-source for controlling and powering the respective components.

Figure 11:
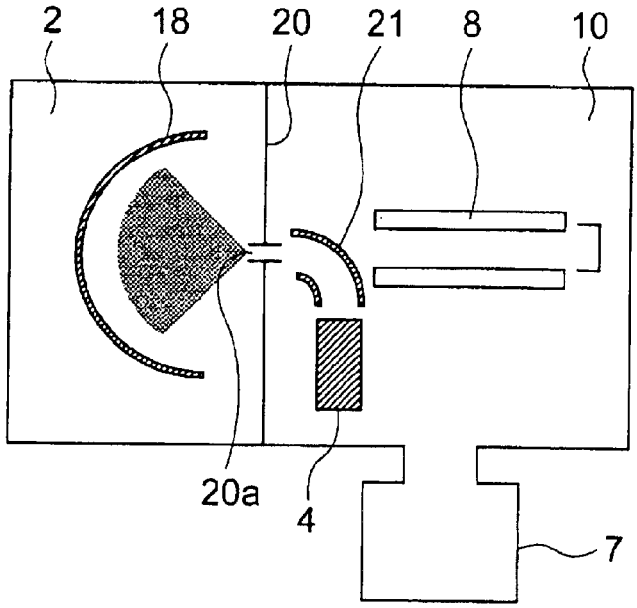
FIG. 11 is a sectional view schematically showing the internal structure of a reflection type ion attachment mass spectrometry apparatus according to an 11th embodiment of the present invention.

Next, an 11th embodiment of the present invention will be explained with reference to FIG. 11. FIG. 11 schematically shows the internal structure of a reflection type ion attachment mass spectrometry apparatus according to the 11th embodiment of the present invention. In FIG. 11, components of substantially the same as components explained in FIG. 1, FIG. 10, etc. are assigned the same reference numerals and detailed explanations are omitted. Below, the characteristic features of the 11th embodiment will be explained.

In the 11th embodiment shown in FIG. 11, the common compartment 10 is provided with an electrostatic deflector 21. A partition 20 with a common aperture 20*a* is provided between the attachment region 2 and the common compartment 10. The attachment region 2, as shown in the 10th embodiment, is provided with a reflector 18 formed so as to generate a spherical electric field. The electrostatic deflector 21 is configured for high speed switching between a deflection electrostatic field bending the metal ions emitted from the metal ion emitter 4 by 90° and the state of no electric field allowing the attached ions to proceed straight. This configuration switches both the left and right voltages (left side is minus voltage, while right side is plus voltage) supplied to the left and right electrodes (plate members formed in curved shape) shown in FIG. 11 in the electrostatic deflector 21 alternately between a predetermined voltage and zero voltage by microsecond time intervals and sets the time for zero potential between them. Due to this, when supplying the electrostatic deflector 21 with minus and plus voltages, the metal ions are deflected by 90°. When held at zero potential, the reflected attached ions head directly toward the mass spectrometer 8. The metal ions emitted from the metal ion emitter 4 are bent 90° by the electrostatic deflector, pass through the aperture 20*a* of the common-aperture partition 20, and are transported and introduced to the attachment region 2. The attached ions produced in the attachment region 2 is reflected through the aperture 20*a* of the common-aperture partition 20, then proceed directly through the electrostatic deflector 21 with no electric field and are transported to the mass spectrometer 8. Note that at this time, the electrode of the right side of the electrostatic deflector 21 shown in FIG. 11 is formed with a passage for the attached ions to pass. When the switching timing is set so that the switching interval may coincide with the transport and reflection of the metal ions and generation and transport of the attached ions, measurement can be performed without major loss. The rest of the configuration and operation is the same as the configuration explained in the eighth embodiment.

According to the 11th embodiment, the ions are reflected 180°, so come to a complete stop at the time of reflection. The efficiency of attachment also becomes extremely high.

Although not specifically illustrated, this embodiment includes a control system and a power-source for controlling and powering the respective components.

Figure 12:
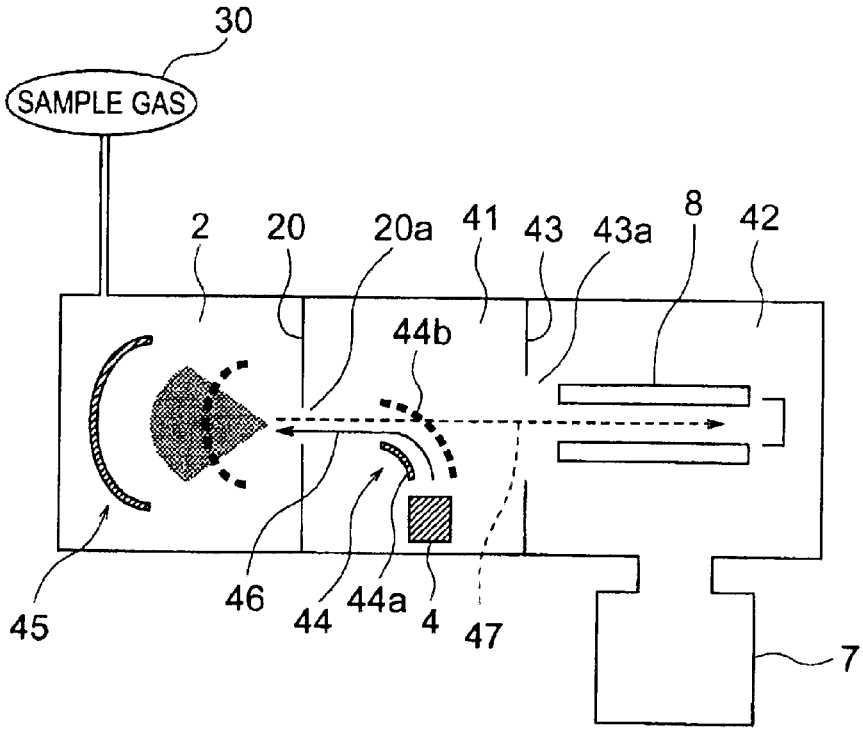
FIG. 12 is a sectional view schematically showing the internal structure of a reflection type ion attachment mass spectrometry apparatus according to a 12th embodiment of the present invention.

Next, a 12th embodiment of the present invention will be explained with reference to FIG. 12. FIG. 12 schematically shows the internal structure of a reflection type ion attachment mass spectrometry apparatus according to the 12th embodiment of the present invention. The 12th embodiment is a modification of the 11th embodiment. In FIG. 12, components of substantially the same as components explained in FIG. 1, FIG. 11, etc. are assigned the same reference numerals and detailed explanations are omitted. Below, the characteristic features of the 12th embodiment will be explained.

In this embodiment, as the overall structure, as shown in FIG. 12, the attachment region 2, metal ion generation region 41, and mass spectrometry region 42 are arranged in that order from the left side of the figure. A partition 43 having an aperture 43*a* is provided between the metal ion generation region 41 and the mass spectrometry region 42. In this embodiment, the metal ion generation region and the mass spectrometry region are not formed as a common region.

In the metal ion generation region 41, an electrostatic deflector 44 of time varying control voltage is used, while at attachment region 2, reflector comprising two electrodes 45 are used. Note that in FIG. 12, 46 indicates the path of movement of metal ions, while 47 shows the path of movement of attached ions.

Figure 13:
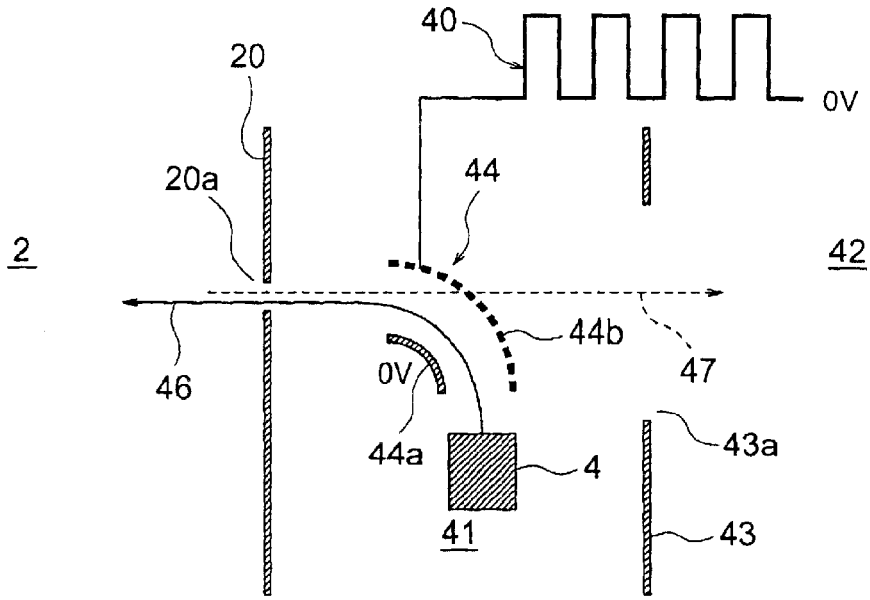
FIG. 13 is a sectional view schematically showing the principal structure of a reflection type ion attachment mass spectrometry apparatus according to the 12th embodiment of the present invention.

Details of the electrostatic deflector 44 are shown in FIG. 13. In the electrostatic deflector 44, the voltage of the sector type inside electrode 44*a* is made 0V at all times, while that of the outside electrode 44*b* is altered in time with a plus voltage of a required level and 0V in the pulse waveform. The outside electrode 44*b* is grid shaped and is designed to allow the passage of ions. The metal ions 46 emitted from the metal ion emitter 4 are deflected by the electric field between the two electrodes, pass through the two-ion passing aperture 20*a,* and enter the attachment region 2 when the outside electrode 44*b* is at a plus voltage. The attached ions 47 leaving the attachment region 2 through the two-ion passing aperture 20*a* proceed straight and enter the mass spectrometry region 42 when the outside electrode 44*b* is 0V.

In the attachment region 2, the metal ions are decelerated, so the time from when the metal ions enter the two-ion passing aperture 20*a* to when they become attached ions and leave the region is relatively long, so timing control is easy.

Figure 14:
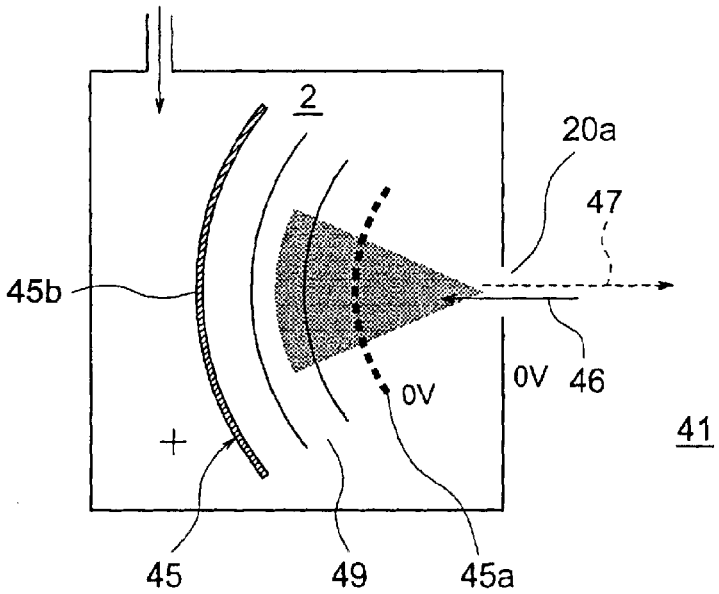
FIG. 14 is a sectional view schematically showing the principal structure of a reflection type ion attachment mass spectrometry apparatus according to the 12th embodiment of the present invention.

Details of the reflection electrode 45 are shown in FIG. 14. The reflection electrode 45 has inside and outside portions 45*a* and 45*b* both spherically shaped. Their centers match with the two-ion passing aperture 20*a*. The inside reflection electrode 45*a* is grid shaped and allows the passage of ions. The inside reflection electrode 45*a* has the same potential as that near the two-ion passing aperture 20*a* of 0V, while the outside reflection electrode 45*b* is supplied with a plus voltage. The metal ions 46 passing through the two-ion passing aperture 20*a* and entering the attachment region 2 spread out in a cone having the two-ion passing aperture 20*a* as a focal point. This is because the metal ions are decelerated and as a result the lateral translation motions become dominant and the time of action for the Coulomb repulsion force between each metal ion becomes longer. However, the electric field of the attachment region 2 becomes a spherical electric field 49 having the two-ion passing aperture 20*a* as a focal point, so all metal ions receive a force in the opposite direction as the direction of progression and are decelerated. While the metal ions are decelerating and stop, attached ions are formed. Then the attached ions are accelerated in the completely opposite direction due to the spherical electric field 49. The direction of acceleration is that toward the two-ion passing aperture 20*a,* so all attached ions 47 are concentrated at the two-ion passing aperture 20*a* and pass through it. That is, the metal ions entering the attachment region 2 from the two-ion passing aperture 20*a* completely stop at the reflection point (turnaround point). The produced attached ions travel back over the original path and pass through the two-ion passing aperture 20*a*.

A spherical electric field is not formed between the inside reflection electrode 45*a* and the vicinity of the two-ion passing aperture 20. A free space is formed between them. Therefore, if the ions can travel without substantial collisions in the space, they can reach the two-ion passing aperture. To satisfy the before-mentioned condition, the pressure of the attachment region 2 is preferably in the molecular flow region where the ions can freely fly (less than 10 Pa). If a viscous flow region where ions cannot freely fly (more than 10 Pa), the ions are liable to lose their kinetic energy in the middle and stagnate there.

Although not specifically illustrated, this embodiment includes a control system and a power-source for controlling and powering the respective components.

Figure 15:
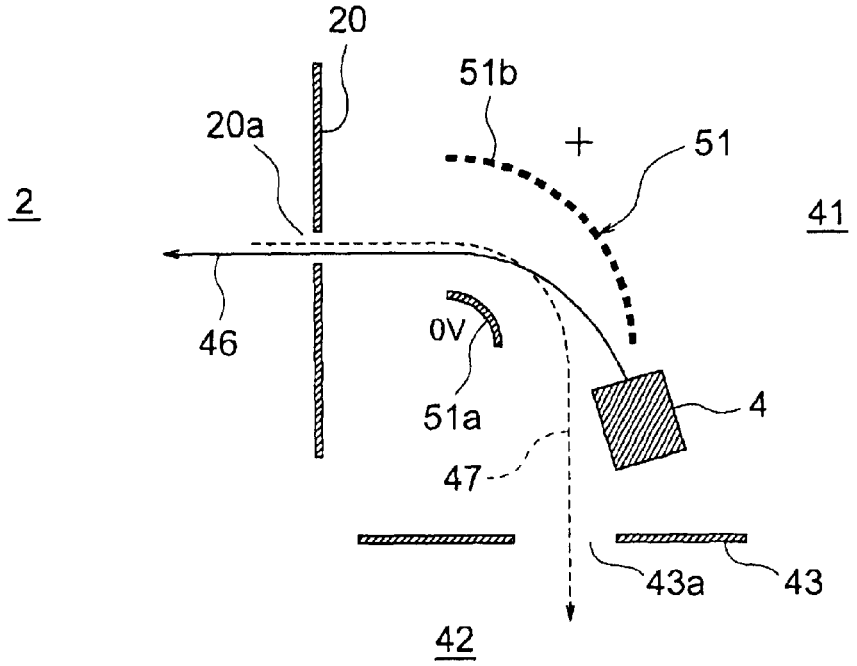
FIG. 15 is a sectional view schematically showing the principal structure of a reflection type ion attachment mass spectrometry apparatus according to a 13th embodiment of the present invention.

Next, a 13th embodiment of the present invention will be explained with reference to FIG. 15. FIG. 15 schematically shows principal parts of a reflection type ion attachment mass spectrometry apparatus according to the 13th embodiment of the present invention. The 13th embodiment is a modification of the 12th embodiment. In FIG. 15, components of substantially the same as components explained in FIG. 12 are assigned the same reference numerals and detailed explanations are omitted. Below, the characteristic features of the 13th embodiment will be explained.

In this embodiment, the configuration of the electrostatic deflector of the metal ion generation region 41 is changed. In this embodiment, the mass spectrometry region 42 is arranged with respect to the attachment region 2 so as to be at a position shifted from the direction of movement of the ions at the instant of passage through the two-ion passing aperture, for example, in the perpendicular direction. Therefore, the electrostatic deflector 51 according to this embodiment links the attachment region 2 and the mass spectrometry region 42 in a perpendicular positional relationship.

Next, the case where the mass spectrometry region 42 is arranged perpendicular to the attachment region 2 will be explained. In FIG. 15, the sector type inside electrode 51*a* is made 0V, while the outside electrode 51*b* is supplied with a plus voltage at all times. The metal ions 46 emitted from the metal ion emitter 4 enter between the two electrodes at a slant, are deflected by about 60° to enter into the two-ion passing aperture 20*a* of the partition 20, and enter the attachment region 2. The attached ions 47 leaving the attachment region 2 lose their kinetic energy and are easily bent, so are deflected by 90° between the two electrodes and enter the mass spectrometry region 42. If the pressure of the attachment region 2 becomes the viscous flow region (more than 1 Pa), the kinetic energy lost by the attached ions 47 becomes greater. The value of the energy of the attached ions can be determined, so control of the path becomes easier.

Note that shifting the axis of the mass spectrometry region 42 from the metal ion emitter 4 can prevent the neutral molecules and light emitted from the metal ion emitter 4 from entering the mass spectrometry region 42, causing background level, and contaminating the mass spectrometer.

Although not specifically illustrated, this embodiment includes a control system and a power-source for controlling and powering the respective components.

Figure 16:
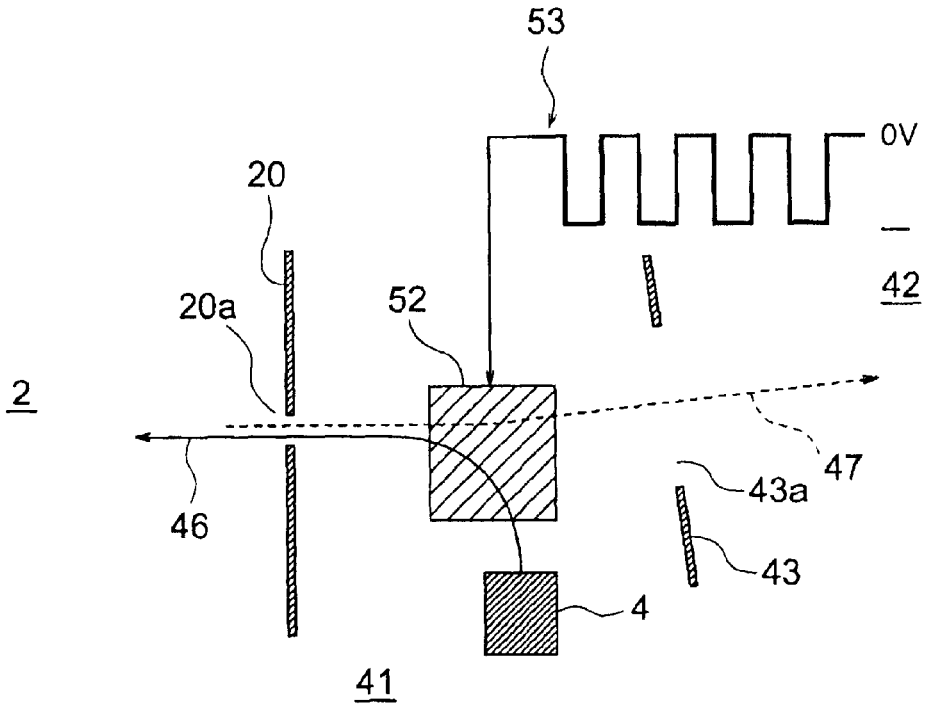
FIG. 16 is a sectional view schematically showing the principal structure of a reflection type ion attachment mass spectrometry apparatus according to a 14th embodiment of the present invention.

Next, a 14th embodiment of the present invention will be explained with reference to FIG. 16. FIG. 16 schematically shows principal parts of a reflection type ion attachment mass spectrometry apparatus according to the 14th embodiment of the present invention. The 14th embodiment is a modification of the 12th embodiment. In FIG. 16, components of substantially the same as components explained in FIG. 13 are assigned the same reference numerals and detailed explanations are omitted. Below, the characteristic features of the 14th embodiment will be explained.

In this embodiment, the deflector of the metal ion generation region 41 is changed to a magnetic field type apparatus. The mass spectrometry region 42 is arranged at a slight angle with respect to the direction for the attached ions to be ejected. In this magnetic field deflector 52, the magnetic field is generated by using a mechanism of two rectangular plate-shaped permanent magnets arranged in parallel. Both of the two permanent magnets are made the same potential and alternately supplied with 0V and a minus voltage as shown by the rectangular shaped pulse wave 53. The metal ions 46 emitted from the metal ion emitter 4 are deflected 90° by the magnetic field between the permanent magnets and enter the attachment region 2 when the permanent magnets are made 0V. The attached ions 47 leaving the attachment region 2 are increased in kinetic energy when passing between the permanent magnets when the permanent magnets are supplied with minus voltage and become harder to bend. Further, the attached ions become heavier than the metal ions by exactly the amount of the sample molecules, so enter the mass spectrometry region 42 by just being deflected by small angle.

The structure for causing the metal ions 46 to enter the attachment region 2 by the deflection due to the magnetic field has an effect on preventing interference ions and ghost ions. These technical matters are discussed in Japanese Patent Application No. 2002-264552. Also, the structure for causing the attached ions 47 to enter the mass spectrometry region 42 by the just deflection due to the magnetic field has an effect on preventing background signals and ghost signals. These technical matters are discussed in Japanese Patent Application No. 2003-72169. Accordingly, the present embodiments make the above effects at the same time. In addition, the above two effects are similarly generated in the following 15th embodiment.

Although not specifically illustrated, this embodiment includes a control system and a power-source for controlling and powering the respective components.

Figure 17:
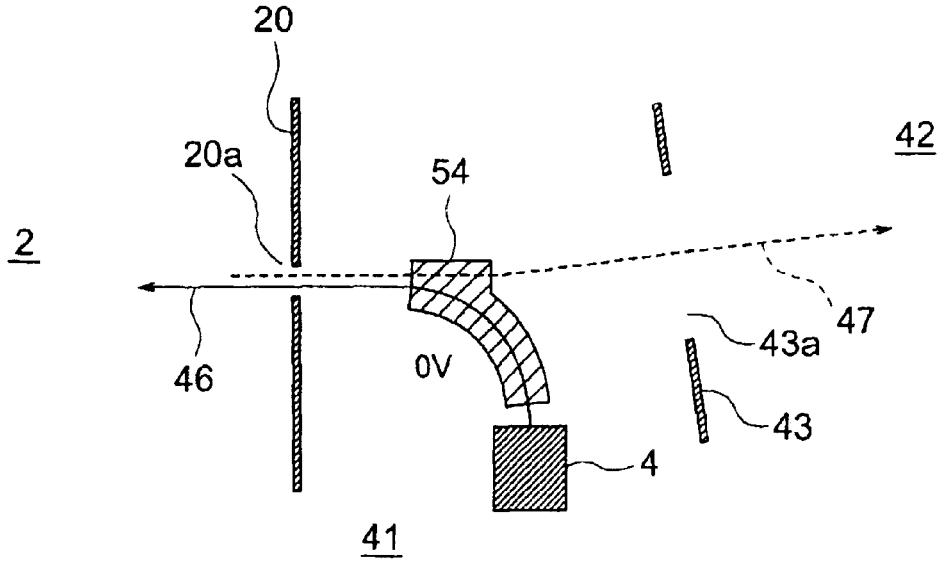
FIG. 17 is a sectional view schematically showing the principal structure of a reflection type ion attachment mass spectrometry apparatus according to a 15th embodiment of the present invention.

Next, a 15th embodiment of the present invention will be explained with reference to FIG. 17. FIG. 17 schematically shows principal parts of a reflection type ion attachment mass spectrometry apparatus according to the 15th embodiment of the present invention. The 15th embodiment is a modification of the 14th embodiment. In FIG. 17, components of substantially the same as components explained in FIG. 12, FIG. 13, FIG. 16, etc. are assigned the same reference numerals and detailed explanations are omitted. Below, the characteristic features of the 15th embodiment will be explained.

In this embodiment, the magnetic field deflector of the metal ion generation region 41 is changed. In this magnetic field deflector 54, the permanent magnets are of shape giving a long path of passage of the metal ions 46 and a short path of passage of the attached ions 47 and are constantly made 0V. The metal ions emitted from the metal ion emitter 4 are deflected 90° by the long path and enter the attachment region 2. The attached ions 47 leaving the attachment region 2 are deflected a small angle by the short path and enter the mass spectrometry region 42. The deflection angles of the metal ions and the attached ions are changed by only the difference in lengths of the paths, so there is no need to change the potential of the permanent magnet over time. Further, the potential of the permanent magnet is set to be 0 volt in the present embodiment. But, though it is essential to keep the potential at the same value, the absolute value for the potential is meaningless. For example, the potential of the permanent magnet may be set to be always −100 volt. If the kinetic energy is reduced by half when generating the reflection in the attachment region, that is, for example, in the case that the kinetic energy of the metal ions in entering the attachment region is 10 eV and that in going out of the region is 5 eV, the deflection angle of the attached ions is 1.4 times as many as that of the metal ions when the magnetic potential is zero. The numerical value 1.4 corresponds to a square root of 2 being ratio between the above two kinetic energies. Thus, the deflection angle of the attached ions becomes large in comparison with that of the metal ions. However, if the potential of the permanent magnet is −100 volt, kinetic energies of the metal ions and attached ions are respectively 110 eV and 105 eV when passing through the permanent magnet, and therefore the deflection radius of the attached ions is 1.02 times (square root of 1.05 being ratio between the two kinetic energies) as many as that of the metal ions. Thus, the absolute value of the potential of the permanent magnet, which is always kept to be the same value, can be optionally selected in view of other conditions.

Although not specifically illustrated, this embodiment includes a control system and a power-source for controlling and powering the respective components.

Figure 18:
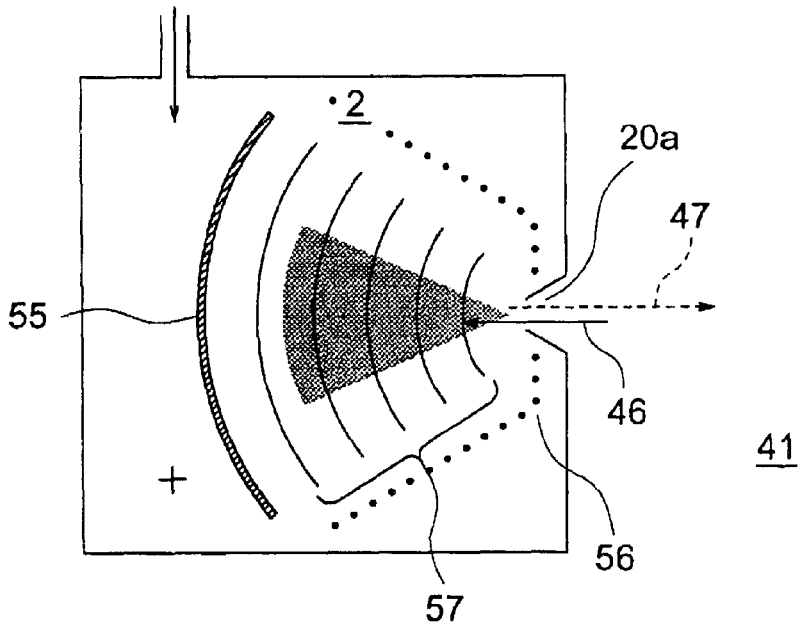
FIG. 18 is a sectional view schematically showing the principal structure of a reflection type ion attachment mass spectrometry apparatus according to a 16th embodiment of the present invention.

Next, a 16th embodiment of the present invention will be explained with reference to FIG. 18. FIG. 18 schematically shows principal parts of a reflection type ion attachment mass spectrometry apparatus according to the 16th embodiment of the present invention. The 16th embodiment is a modification of a reflection electrode of the attachment region. In FIG. 18, components of substantially the same as components explained in FIG. 12, FIG. 14, etc. are assigned the same reference numerals and detailed explanations are omitted. Below, the characteristic features of the 16th embodiment will be explained.

In this embodiment, the shape of the reflection electrodes of the attachment region 2 are changed. In this reflection electrode 55, there is only one outside reflection electrode, and a two-ion passing aperture 20*a* is formed as a cone. A ring shaped correction electrode 56 is provided at the inside periphery. Due to this structure, a substantially spherical electric field 57 from the two-ion passing aperture 20*a* to the reflection electrode 55 is formed over the entire space. Therefore, even if the pressure of the attachment region 2 is the viscous flow region (more than 10 Pa) and on the way the attached ions lose their kinetic energy, the ions will not stagnate at that location, but will be accelerated and can be concentrated at the two-ion passing aperture 20*a*.

Although not specifically illustrated, this embodiment includes a control system and a power-source for controlling and powering the respective components.

Figure 19:
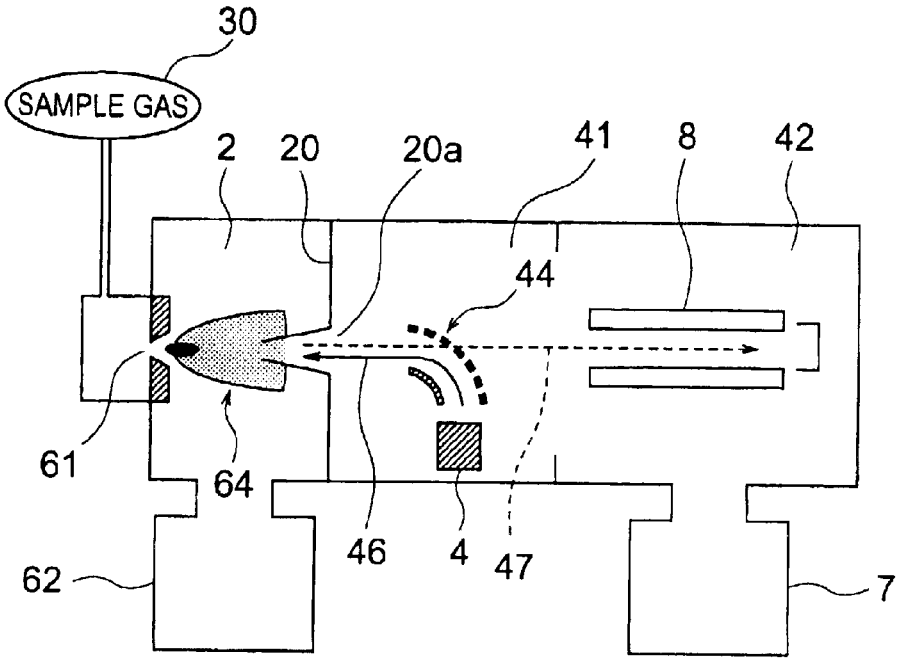
FIG. 19 is a sectional view schematically showing the internal structure of a reflection type ion attachment mass spectrometry apparatus according to a 17th embodiment of the present invention.

Next, a 17th embodiment of the present invention will be explained with reference to FIG. 19. FIG. 19 schematically shows a reflection type ion attachment mass spectrometry apparatus according to the 17th embodiment of the present invention. In FIG. 19, components of substantially the same as components explained in FIG. 12 are assigned the same reference numerals and detailed explanations are omitted. Below, the characteristic features of the 17th embodiment will be explained.

In this embodiment, in the above-mentioned 12th embodiment, the configuration provided at the attachment region 2 is changed to a supersonic type configuration. As the overall structure, as shown in the figure, the portion where the sample gas 30 is introduced to the attachment region 2 is the small aperture of the nozzle 61. Further, the attachment region 2 is provided with an exclusive vacuum pump 62. The rest of the configuration is the same as the configuration explained in the 12th embodiment.

Figure 20:
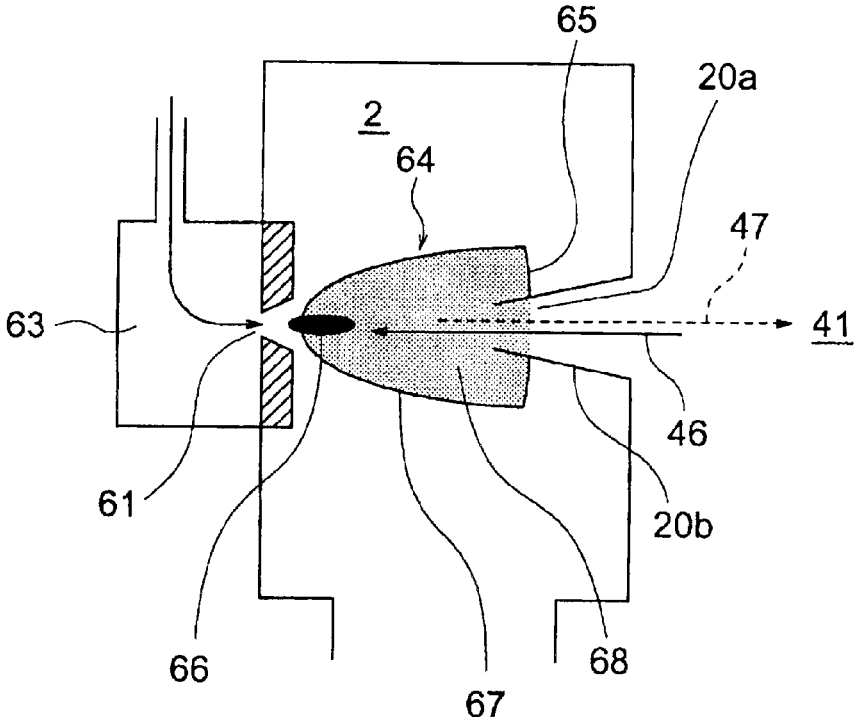
FIG. 20 is a sectional view schematically showing the principal structure of a reflection type ion attachment mass spectrometry apparatus according to a 17th embodiment of the present invention.

The detailed structure of the attachment region 2 is shown in FIG. 20. The pressure of the space 63 at the high-pressure side of the nozzle 61 is substantially atmospheric pressure. The diameter of the nozzle 61 is preferably about 0.1 mm. With this, the low-pressure side becomes less than about 1 Pa. The Mach disk 65 of the supersonic jet 64 extends up to behind the two-ion passing aperture 20*a* formed as a skimmer part 20*b*. In the supersonic jet 64, 66 is a high pressure part, 67 is a barrel shock, and 68 is a silent part. Further, the metal ion generation region 41 side with respect to the two-ion passing aperture 20*a* forms a molecule flow region, so the ions can freely fly. Therefore, the metal ions 46 can enter the inside of the supersonic jet 64 without being obstructed by the Mach disk 65. The metal ions entering the supersonic jet 64 are decelerated by striking the molecules of the sample gas in the high pressure part 66 near the nozzle and efficiently attach to them at the high pressure part 66 and silent part 68. The attached ions get several eV of kinetic energy from the supersonic jet 64, pass through the two-ion passing aperture 20*a*, and enter the mass spectrometer 8 of the mass spectrometry region 42.

Although not specifically illustrated, this embodiment includes a control system and a power-source for controlling and powering the respective components.

Figure 21:
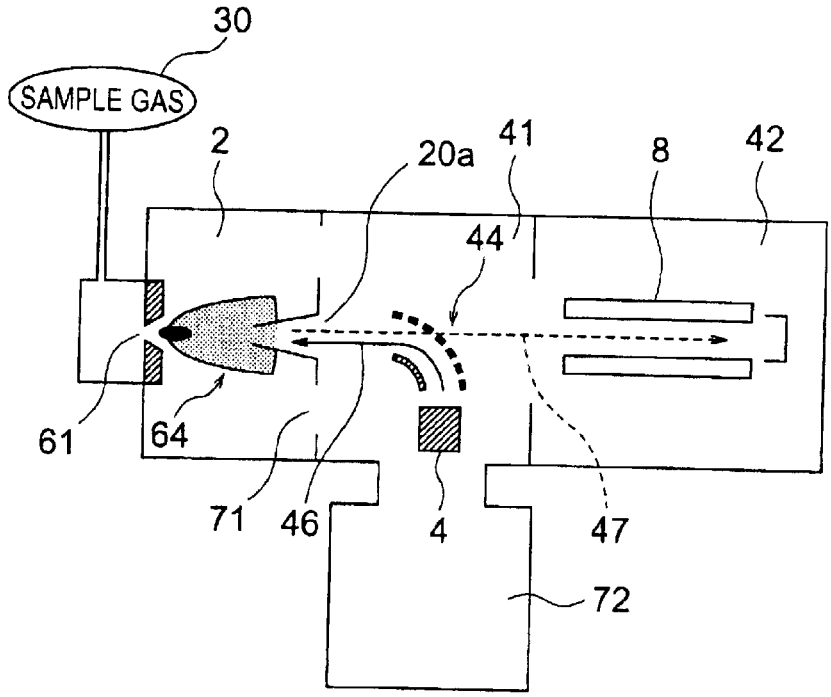
FIG. 21 is a sectional view schematically showing the internal structure of a reflection type ion attachment mass spectrometry apparatus according to an 18th embodiment of the present invention.

Next, an 18th embodiment of the present invention will be explained with reference to FIG. 21. FIG. 21 schematically shows a reflection type ion attachment mass spectrometry apparatus according to the 18th embodiment of the present invention. This embodiment is a modification of the 17th embodiment. In FIG. 21, components of substantially the same as components explained in FIG. 19 are assigned the same reference numerals and detailed explanations are omitted. In this embodiment, the pumps of the attachment region 2 and mass spectrometry region 42 in the above 17th embodiment are abolished. Instead, an exhaust port 71 is provided at the boundary between the attachment region 2 and the metal ion generation region 41, the metal ion generation region 41 is provided with a vacuum pump 72, and the exhaust capability of this single vacuum pump 72 is enlarged. Further, the diameter of the nozzle 61 is made about 0.01 mm and the pressure of the attachment region 2 etc. is not more than $10^{-3}$ Pa. The rest of the configuration and actions are the same as the 17th embodiment explained above.

Although not specifically illustrated, this embodiment includes a control system and a power-source for controlling and powering the respective components.

The embodiments of the present invention can be modified in the following way.

The pressure of the attachment region was made 1 Pa for free flight of the ions, but complete free flight is not necessarily an essential condition. Sometimes some problems will occur on the concentration of ions et al. under conditions where part or all of the ions strike the ambient gas, but this is not critical. In particular, the problem of concentration does not arise in the 10th and 11th embodiments.

As the metal ions, $Li^+$ was used, but the invention is not limited to this. It is also possible to use $K^+$, $Na^+$, $Rb^+$, $Cs^+$, $Al^+$, $Ga^+$, $In^+$, and other monovalent ions or bivalent ions. Further, as the mass spectrometer 8, use was made of a Q-pole type mass spectrometer, but the invention is not limited to this. It is also possible to use an ion trap mass spectrometer using the external ionization system, a magnetic field sector mass spectrometer, a TOF (time of flight) mass spectrometer, or an ICR (ion cyclotron resonance) mass spectrometer.

The measured gas may be not only a substance in the gaseous state from the start, but also a substance which is originally solid or liquid but becomes a gas due to some means or another. Further, it is also possible to connect this apparatus to another separation apparatus, for example, a gas chromatograph or liquid chromatograph, to form a gas chromatograph/mass spectrometer (GC/MS) and liquid chromatograph/mass spectrometry (LC/MS).

The configuration, shape, size, and positional relationship explained in the embodiments are shown only schematically to an extent enabling the present invention to be understood and worked. Further, the numerical values and the compositions of the components (materials) are only illustrative. Therefore, the present invention is not limited to the embodiments explained above. Various modifications are possible so long as not exceeding the gist of the technical idea shown in the claims.

The present disclosure relates to subject matter contained in Japanese Patent Application No. 2002-264553, filed on Sep. 10, 2002 and Japanese Patent Application No. 2003-95456, filed on Mar. 31, 2003, the disclosure of which is expressly incorporated herein by reference in its entirety.

What is claimed is:

1. A reflection type ion attachment mass spectrometry apparatus comprising a metal ion generation region in which positively charged metal ions are generated and an attachment region in which the metal ions attach to molecules of a measured gas to generate attached ions and a mass spectrometry region in which mass spectrometry of said attached ions is performed, wherein:

said metal ion generation region and said mass spectrometry region are formed as a common compartment, said attachment region is provided adjoining said common compartment, and said attachment region is provided with an electrostatic field generating means for forming an electrostatic field for reflecting said metal ions introduced from said metal ion generation region so as to guide the metal ions to said mass spectrometry region.

2. The reflection type ion attachment mass spectrometry apparatus as set forth in claim 1, wherein the attached ions are accelerated and concentrated by said electrostatic field reflecting said metal ions.

3. The reflection type ion attachment mass spectrometry apparatus as set forth in claim 1, wherein said electrostatic field generating means forms an electrostatic field without using a grid where said metal ions or said attached ions pass.

4. The reflection type ion attachment mass spectrometry apparatus as set forth in claim 1, wherein a correction field is superposed on the electrostatic field to adjust the paths of said metal ions and attached ions.

5. The reflection type ion attachment mass spectrometry apparatus as set forth in claim 1, wherein the distribution of intensity of the electrostatic field is of axially symmetric ellipsoid.

6. The reflection type ion attachment mass spectrometry apparatus as set forth in claim 1, wherein the distribution of intensity of the electrostatic field is spherical.

7. The reflection type ion attachment mass spectrometry apparatus as set forth in claim 1, wherein a partition having an aperture for introducing said metal ions from said metal ion generation region to said attachment region and transporting said attached ions from said attachment region to said mass spectrometry region is provided between said attachment region and the region of said metal ion generation region and said mass spectrometry region.

8. The reflection type ion attachment mass spectrometry apparatus as set forth in claim 1, wherein a translational energy of said metal ions is reduced by reflection.

9. The reflection type ion attachment mass spectrometry apparatus as set forth in claim 8, wherein the attached ions are accelerated and concentrated by said electrostatic field reflecting said metal ions.

10. The reflection type ion attachment mass spectrometry apparatus as set forth in claim 8, wherein said electrostatic field generating means forms an electrostatic field without using a grid where said metal ions or said attached ions pass.

11. The reflection type ion attachment mass spectrometry apparatus as set forth in claim 1, wherein a partition having an aperture for introducing said metal ions from said metal ion generation region to said attachment region and an aperture for transporting said attached ions from said attachment region to said mass spectrometry region is provided between said attachment region and the region of said metal ion generation region and said mass spectrometry region.

12. The reflection type ion attachment mass spectrometry apparatus as set forth in claim 11, wherein a path of said metal ions before entering said common aperture and a path of said attached ions after departing from said common aperture are separated by an electric field or magnetic field.

13. The reflection type ion attachment mass spectrometry apparatus as set forth in claim 12, wherein the distribution of the electric field of said attachment region is made a sphere centered on said common aperture.

14. The reflection type ion attachment mass spectrometry apparatus as set forth in claim 12, wherein a supersonic jet is formed in said attachment region.

15. The reflection type ion attachment mass spectrometry apparatus as set forth in claim 13, wherein a supersonic jet is formed in said attachment region.

16. A reflection type ion attachment mass spectrometry apparatus comprising a metal ion generation region in which positively charged metal ions are generated and an attachment region in which the metal ions attach to molecules of a measured gas to generate attached ions and a mass spectrometry region in which mass spectrometry of said attached ions is performed, the apparatus further comprising:

a reflection type structural member introducing said metal ions to said attachment region, causing said metal ions to attach to molecules of measured gas to generate the attached ions while reflecting said metal ions at said attachment region, and ejecting said attached ions from said attachment region and performing mass spectrometry on said attached ions by a mass spectrometer, and an aperture by which said metal ions enter said attachment region and an aperture by which said attached ions are ejected from said attachment region being the same common aperture.

17. The reflection type ion attachment mass spectrometry apparatus as set forth in claim 16, wherein a supersonic jet is formed in said attachment region.

* * * * *